US006280072B1

(12) United States Patent
Poston

(10) Patent No.: US 6,280,072 B1
(45) Date of Patent: Aug. 28, 2001

(54) HAND HELD CEMETITIOUS MIXING TOOL

(76) Inventor: Carl Bennett Poston, Rte. 1, Box 1331, Hemphill, TX (US) 75948

( * ) Notice: Subject to any disclaimer, the term of this patent is extended or adjusted under 35 U.S.C. 154(b) by 0 days.

(21) Appl. No.: 09/547,681

(22) Filed: Apr. 12, 2000

(51) Int. Cl.[7] ..... B28C 5/44

(52) U.S. Cl. ..... 366/1; 366/129; 366/342; 111/7.1; 239/532

(58) Field of Search ..... 366/1, 129, 130, 366/343, 342, 349, 64, 67; 239/522, 532, 289; 111/7.1, 7.2; 172/377, 378, 376; 15/235.6; 404/97, 118

(56) References Cited

U.S. PATENT DOCUMENTS

| | | | | |
|---|---|---|---|---|
| D. 343,555 | * | 1/1994 | Bonner, III . | |
| 581,493 | * | 4/1897 | Saltsman | 366/129 |
| 1,103,484 | * | 7/1914 | Clarke | 366/1 |
| 1,275,382 | * | 8/1918 | Camp | 111/7.1 |
| 1,408,584 | * | 3/1922 | Glasgow | 366/1 |
| 1,594,984 | * | 8/1926 | Stafford | 172/376 |
| 1,659,024 | * | 2/1928 | Hamilton | 366/1 |
| 1,719,400 | * | 7/1929 | Hampson | 172/378 |
| 1,764,699 | * | 6/1930 | Simola et al. | 366/1 |
| 2,804,767 | * | 9/1957 | Schoen | 111/7.1 |
| 3,435,903 | * | 4/1969 | Sherrod, Jr. | 172/376 |
| 4,720,208 | * | 1/1988 | Spigarelli | 404/97 |
| 4,828,427 | * | 5/1989 | Nisenbaum | 404/97 |
| 5,060,343 | * | 10/1991 | Nisenbaum | 15/145 |
| 5,361,849 | * | 11/1994 | Moore | 111/7.1 |
| 5,947,039 | | 9/1999 | Lundgren et al. | 111/7.1 |

* cited by examiner

*Primary Examiner*—Tony G. Soohoo
(74) *Attorney, Agent, or Firm*—Michael B. Jolly

(57) ABSTRACT

A handheld cementitious mixing tool with a rectangle shaped mixing head vertically oriented and attached to an end of a tubular tool handle with a plurality of horizontal mixing blades angled so that when the mixing head is pulled towards the user the cementitious material is lifted by the angled mixing blades and then dropped thereby mixing the cementitious material. Water is simultaneously added to the cementitious material through an integral water delivery system which includes a handle incorporated water valve and tubing extending from the water valve through the tubular tool handle to water nozzles directed to deliver water to an area immediately before the cementitious material is subjected to the mixing head. An ergonomically designed intermediate handle is provided which is slidingly and rotational adjustable about the tool tubular handle. The tool operates by pulling rather than pushing through cementitious material thereby alleviating fatigue and the possibility of worker injury.

6 Claims, 3 Drawing Sheets

HAND HELD CEMETITIOUS MIXING TOOL

TECHNICAL FIELD

The present invention relates to hand held mixing tools for cementitious material and particularly to a hand held cementitious mixing tool with a mixing head attached to an elongated handle which is operated by pulling the tool through cementitious material providing a mixing motion which lifts and drops the material while a water delivery system contained within the handle concurrently delivers water to material to be mixed.

BACKGROUND ART

Mixing small batches of cementitious material has always been a burdensome task. Even though large batches of cementitious type material are easily mixed with power mixers, when a small batch of cementitious material is needed for a job one is usually relegated to utilizing a hoe, shovel, spade, or some other device not particularly suitable for the job. Numerous handheld mixing devices have been patented which have attempted to ease the effort for mixing small batches of cementitious material. Although these prior art devices are extremely useful for their stated purposes they have not provided a device, as the present invention which is particularly designed for pulling through material to be mixed. The present invention includes; a vertically orientated mixing head with multiple angled horizontal mixing blades which lift and drop the cementitious material as the tool is pulled through the material thereby providing an efficient mixer tool, a mixing head dimensioned to reach corners of framed areas or mixing troughs, a water delivery system which includes nozzles located near the mixing head and directed to deliver water to the cementitious material immediately before the cementitious material is subjected to the mixing head, a handle incorporated water valve and tubing extending from the water valve through the tubular tool handle to the water nozzles, an ergonomically designed intermediate handle which is slidingly and rotational adjustable about the tool tubular handle. The tool also may include lengthened handles to reach well over concrete forms for mixing in place. The tool provides an easy to utilize mixer which helps prevent worker injuries and relieves fatigue since the tool is pulled rather than pushed through the material to be mixed. The tool is also easily utilized in mixing batches of cementitious material in wheel barrows, mixing troughs and the like.

One of the prior art patents include U.S. Pat. No. 5,947,039 to Lundgren, et al which describes and claims a handheld water injecting mixing tool with a generally triangular shaped mixing blade attached to a tubular body and handle. Although this device is extremely useful, the triangular shape blade is oriented so that mixing is accomplished by pushing the blade through cementitious material. Once the user has pushed the triangular shaped mixing blade through the cementitious material, in some circumstances it is extremely difficult for the user to then withdraw the mixing blade from the cementitious material for additional mixing and also inadvertently digs through or tears plastic moisture barriers. The Lundgren device requires a pressurized water delivery system to open the water delivery valve and nozzles. The present invention is designed to be pulled rather than pushed through the cementitious material, thereby easing the strain on the user's back. The present includes a mixing head of a substantially rectangular shape which is vertically orientated with a plurality of uplifting angled horizontal positioned mixing blades which provide lifting of the cementitious material as the mixer is pulled towards the user. Accordingly, a user will not be required to lift the present invention from the cementitious material when one's self is extended over a working area thereby substantially decreasing the potential for injury. Additionally, the present invention with the plurality of uplifting angled mixing blades provides an extremely efficient churning of the cementitious material in the presence of water so that the mixing process is accomplished rapidly. The rectangular shapes mixing head of the present invention also allows the device to cleanly scrape the side surfaces and/or bottom surface of any mixing container thereby providing complete mixing of all areas of the cementitious material. The present invention also has a water delivery system which does not require a pressurized water supply such as the Lundgren device thereby allowing the device to be used in remote areas with gravity water feed supply. The present device is particularly useful for fence builders and landscapers who use concrete in inaccessible locations without pressurized water supply.

Other prior art mixing tools include U.S. Pat. No. 3,143,984, U.S. Pat. No. 1,408,584, U.S. Pat. No. 1,764,699, U.S. Pat. No. 3,326,306 and U.S. Pat. No. 2,181,189. These additional prior art inventions do not include the mixing head as described herein coupled with water injecting means.

Those skilled in the art can appreciate the difficulty required in hand mixing cementitious material and the need for utilizing a mechanical advantage whenever possible to avoid the potential for injury. The present invention, with multiple blades angled for lifting when the mixing head is pulled towards the user advantageously utilizes the most stable and less injury prone stance of the user. Additionally, the present invention includes an integral water delivery system with an ergonomically positioned water valve lever, ergonomically positioned intermediate support handle, and lightweight polypropylene tubing extending from the water delivery valve to water nozzles positioned for delivery of water to the material immediately before contact with the mixing head. The integral water delivery system provides a light weight system to further reduce fatigue, by providing tubing extending from the valve to the nozzles which minimizes the volume and weight of the water that resides in the device. The prior art devices, such as Lundgren, include a tubular handle with water flowing there through, which amounts to a substantial increase in weight of the tool and increased fatigue.

GENERAL SUMMARY DISCUSSION OF INVENTION

It is thus an object of the invention to provide a handheld cementitious mixing tool which rapidly, and efficiently, mixes cementitious material while the user may simultaneously add water by an integrally installed water delivery system.

It is a still further object of the invention to provide a handheld cementitious mixing tool wherein a user pulls the tool to mix cementitious material rather than pushing thereby decreasing the chances for worker injury and fatigue.

Accordingly a handheld cementitious mixing tool is provided with a rectangular shaped mixing head positioned substantially vertical and attached to an end of a tubular tool handle, the mixing head includes multiple horizontal mixing blades angled so that when the mixing head is pulled toward the user the cementitious material is lifted by the angled mixing blades and then dropped thereby efficiently and rapidly mixing the cementitious material, water is simultaneously added through an integral water delivery system with a handle incorporated water valve and tubing extending from the water valve through the tubular tool handle to water nozzles, wherein the water nozzles direct water delivery to an area immediately before the cementitious material is subjected to the mixing head, an ergonomically designed intermediate handle which is slidingly and rotational adjustable about the tool tubular handle.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

It can be seen from the figures and description herein that the hand held cementitious mixing tool provides a tool which helps alleviate worker injury and fatigue by providing a tool which is pulled through cementitious material to be mixed rather than pushing. Those skilled in the art can appreciate that when mixing small batches of cementitious material, such as concrete mix, mortar, and stucco, there is a need for a hand held tool which easily and rapidly helps mix the material with an appropriate amount of water without undue fatigue. Operation of power mixers for mixing small batches is usually not practical or impossible since a power source may not be accessible in hilly areas, backs yards of homes, or areas inaccessible to cement trucks, or the batch needed may be too small to justify the use of a power mixer. Additionally, it may be quicker for a worker to use a hand held tool rather than a power mixer for a small batch. When using hand held tools a possibility always exist for worker injury and fatigue, the design of a hand held tool can help alleviate this draw back. The present invention is particularly designed to help reduce worker injury and fatigue by providing a tool which is pulled rather than pushed through the cementitious material while the worker utilizes a stable stance less prone to back injury.

Figure 2:
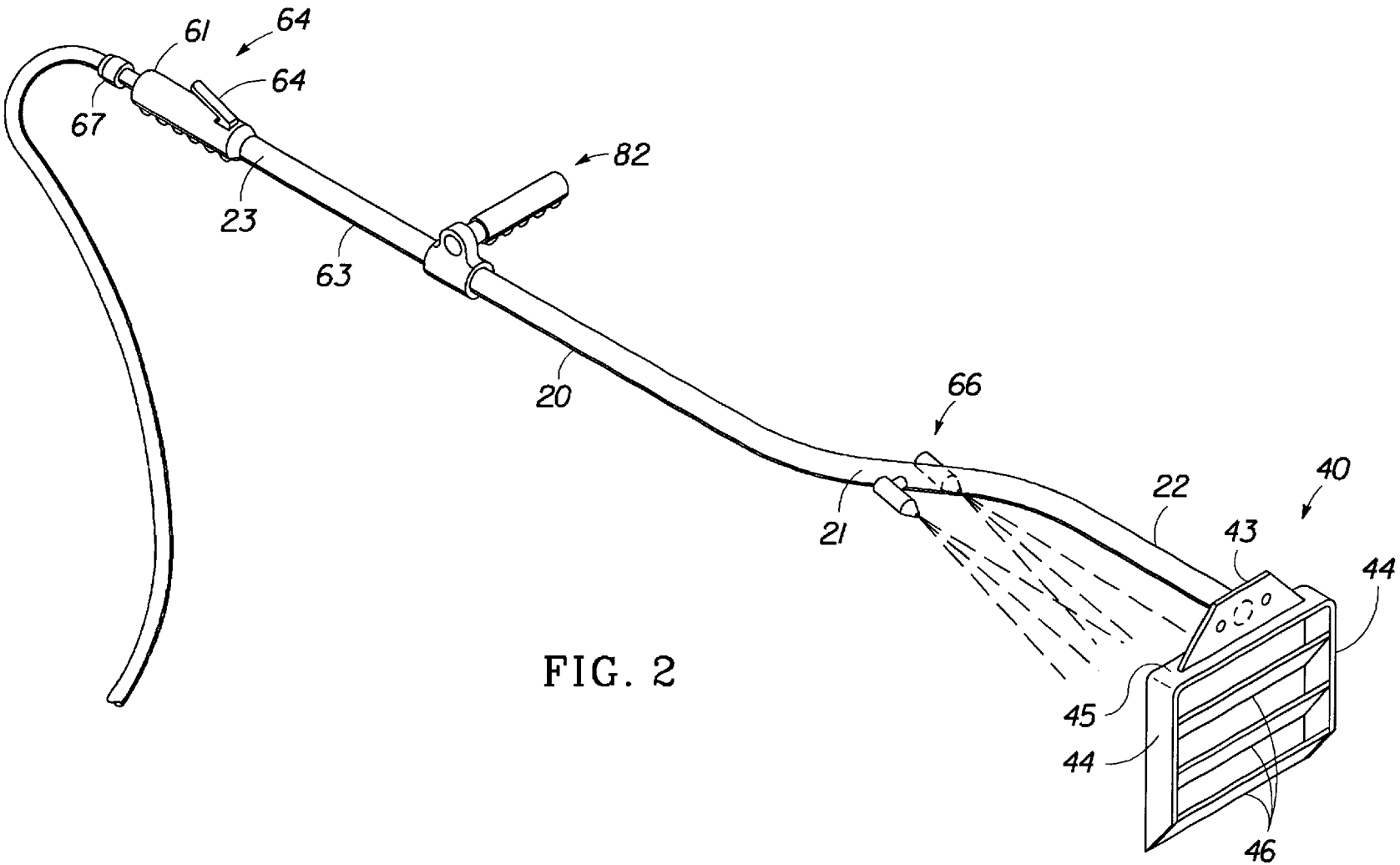
FIG. 2 is an alternative embodiment of the present invention with an angled handle, water delivery system with handle mounted valve delivery water valves, vertically orientated mixing head with multiple horizontal blades angled to provide lifting of the cementitious material when the tool is pulled through the material.

The tool 10 includes a tubular handle 20, mixing head 40, water delivery system 60, and intermediate handle 80. The tubular handle 20 is preferably constructed of light weight durable material such as tubular aluminum and is about five to about eight feet long and about one half to about one inch diameter tubing. FIG. 2 illustrates an alternative embodiment of the invention which includes a curved tubular handle 21 which helps support the tool when not in use and also helps position the mixing head 40 when pulling the tool through cementitious material. The tubular handle 20 has a lower end 22 for attaching the mixing head 40 and an upper end 23 for attaching the hand grip 61. Water nozzles 65 and 66 are attached to the tubular handle lower end 22.

Figure 1:
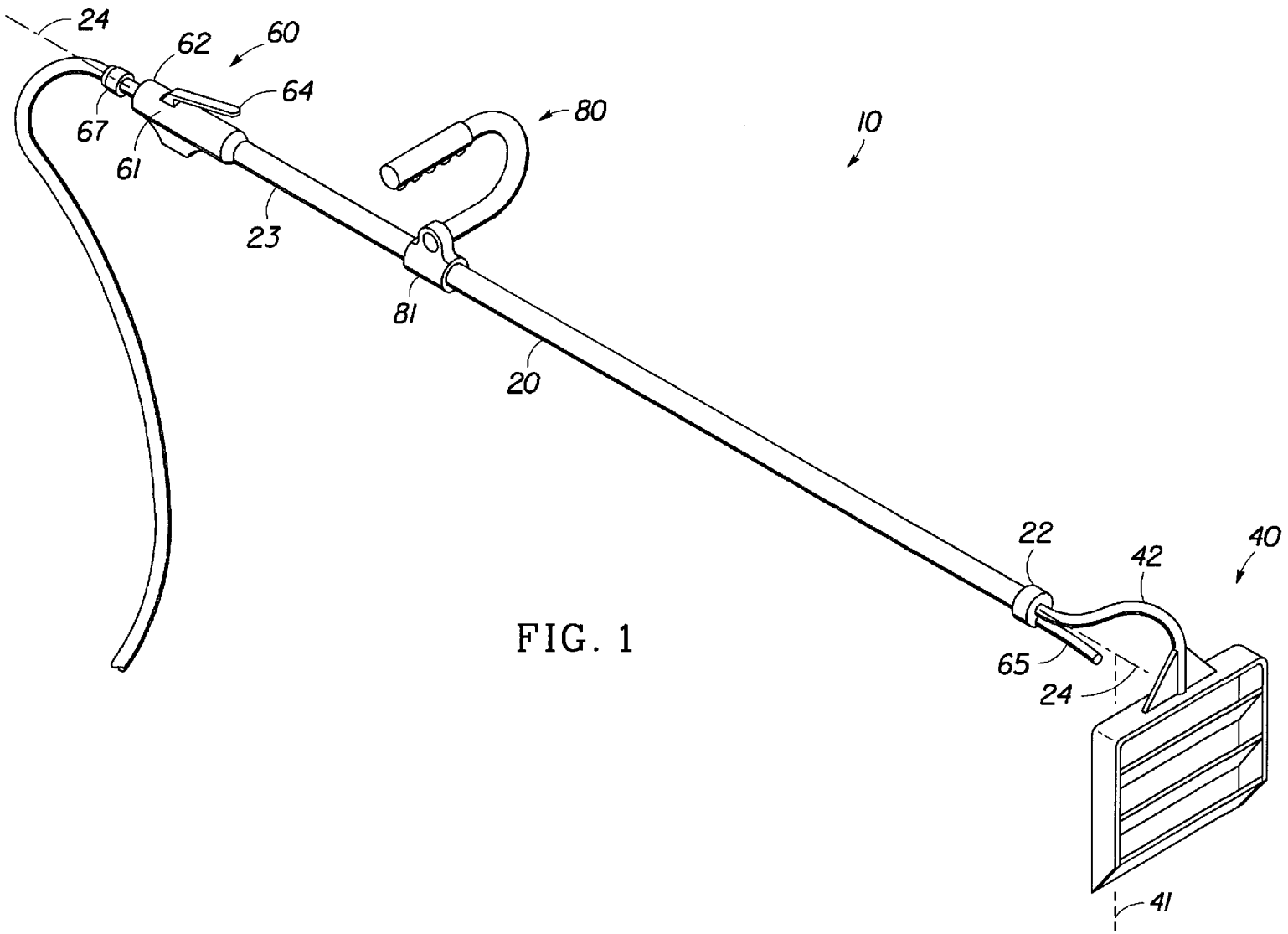
FIG. 1 is a perspective view of a preferred embodiment of the invention illustrating the handheld cementitious mixing tool intermediate handle, mixing head, and water delivery system including a handle mounted valve and nozzles mounted near the mixing head.
Figure 4:
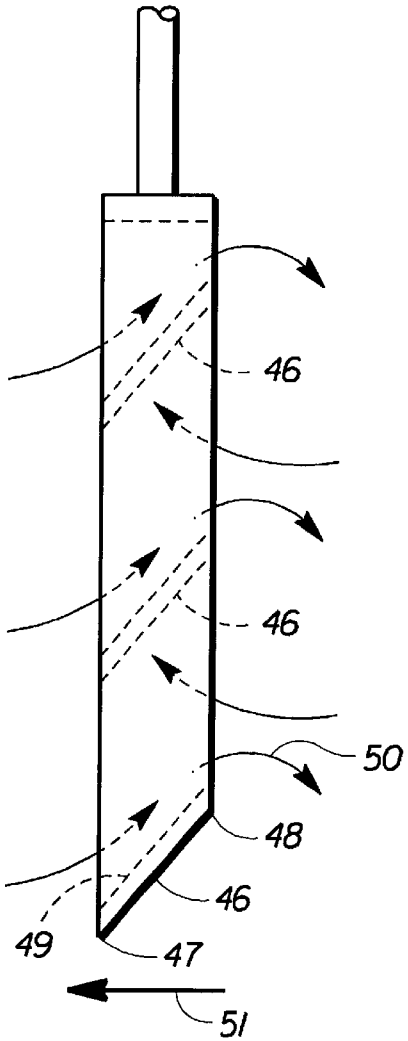
FIG. 4 is a side view of the vertically orientated mixing head with three horizontally positioned angled blades which provide lifting of the cementitious material as indicated by the direction arrows indicated on the figure.
Figure 3:
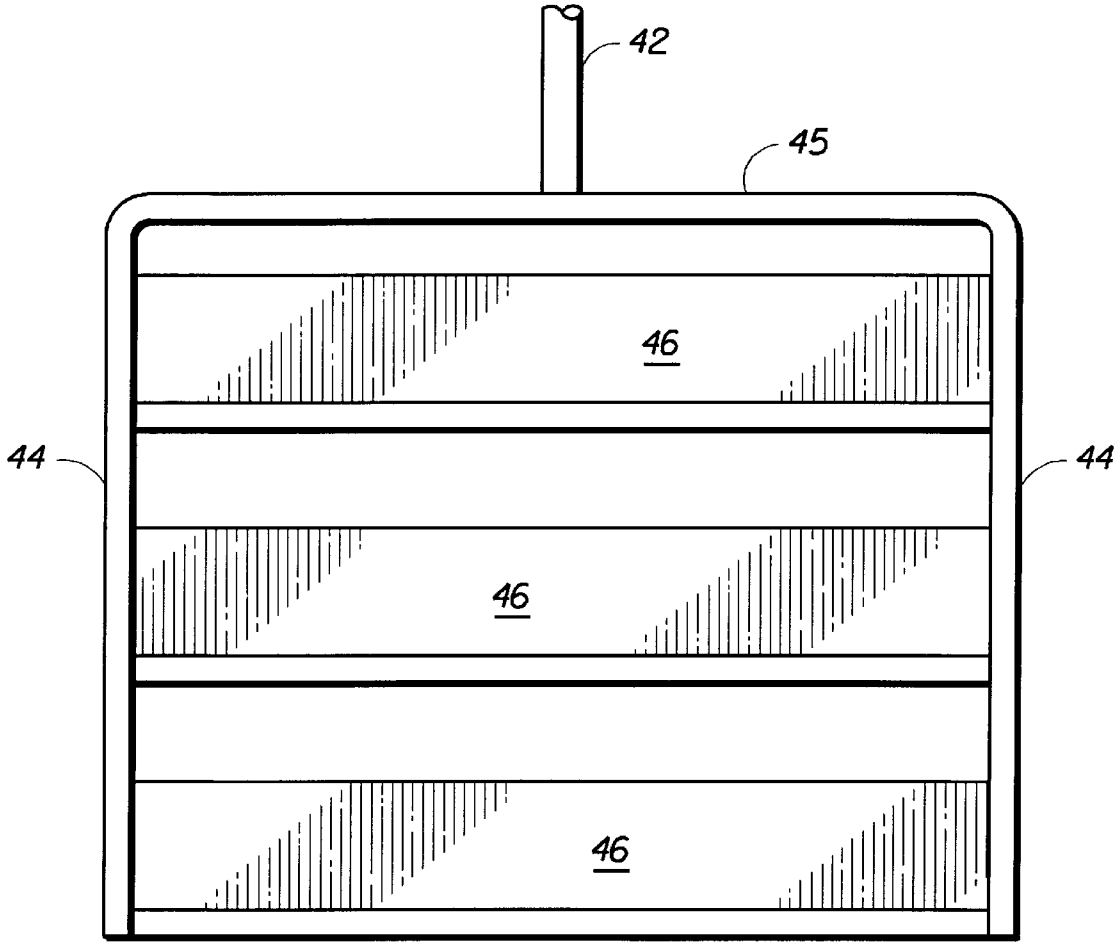
FIG. 3 is an end view of the mixing head illustrating the rectangular frame of the mixing head, multiple horizontally positioned angled blades.

The mixing head 40 is vertically orientated when the tool is in use and has a vertical axis 41 perpendicular to the longitudinal axis 24 of the tubular handle 20. The mixing head 40 is permanently attached to the lower end 22 of the tubular handle 20 by any assortment of attachment means, including a looped bracket 42 as illustrated in FIG. 1, or a straight bracket 43 as illustrated in FIG. 2. Other mixing head attachment means may be employed without deviating from the intent and purpose of the invention. The mixing head 40 is constructed of a frame substantially square or rectangular when viewed from the end as in FIG. 3, with two upright outside opposing vertical frame members 44, a top horizontal frame member 45 extending between a top end of each upright vertical frame member 44. The two upright vertical frame members and the top horizontal frame member resemble an inverted "U" with the bracket 42 or 43 attaching to the horizontal frame member 45. Multiple horizontal mixing blades 46 are mounted between the two upright vertical frame members 44 and are stacked with adequate space between each to allow for the flow of cementitious material as illustrated in FIG. 4. The mixing blades side profile are illustrated in FIG. 4 which show the angled mixing blades 46 with a leading edge 47 orientated down and a trailing edge 48 orientated up, so that when the mixing blades are pulled through cementitious material, in the direction as indicated by the arrow labeled 51 on FIG. 4, the leading edge 47 of the mixing blades lifts the material along a face 49 of the mixing blade 46 upward to the trailing edge 48 where the material then drops behind the trailing edge. The flow of the cementitious material when the mixing blade is draw through the material is depicted by the arrows labeled 50 in FIG. 4. Although the figures illustrate three mixing blades 46 there may be as few as two or as many as six without departing from the intent and scope of the invention. The mixing blades 46, vertical upright members 44 and horizontal member 45 are all constructed of light weight durable material which is easily rinsed and cleaned after use.

The water delivery system 60 includes a hand grip 61 with an integral water valve 62, tubing 63 extending through the tubular handle 20 from the water valve 62 to the water nozzles 66 or 65. The water valve 62 preferable includes a lever 64 which is ergonomically designed for comfortable and easy activation when gripping the hand grip 61. The valve 62 also has connection coupler 67 for easily and quickly attaching the tool to a common garden hose male connector, although other types of hose connectors may be employed such as quick connect-disconnect type connectors. The valve 62 is permanently connected to the tubing 63 extending through the tubular handle 20 to the water nozzles 65 or 66. Using tubing 63 rather than the tubular handle 20 as the means for transporting water from the valve 62 to the water nozzles help reduce the weight of the tool and worker fatigue. The water nozzles 65 and 66 may includes only one nozzle or more. The location of mounting the water nozzles onto the tubular handle preferably allows the water to be delivered onto the cementitious material immediately before the material is contacted by the mixing head and blades. It is also desirable that the water not be delivered under high pressure by a water stream that splatters the cementitious material, this type of water additional is not necessary. The inventor has found that a gently steady stream is most desirable.

The intermediate handle 80 as illustrated in FIG. 1 is slidably and rotationally adjustable about the tubular handle 20 so that any alignment may be achieved by a user to suit his or her comfort needs. The intermediate handle 80 includes a clamping bracket 81 which quickly and securely fixes the handle in a desired location. FIG. 2 illustrates a simplified version 82 of the intermediate handle which is also adjustable both rotationally and slidingly along the tubular handle 20.

In use the tool is first connected to a water supply and the cementitious material is added to the container where the mixing will occur, either in a container or directly in place where the material will be formed. Water is added to the mix as needed, the user lifts the tool over the material container extending the tool away from himself and then allows the tool to fall in the material. The tool is worked down into the material and pulled toward the user while simultaneously adding water as needed. The tool can be used to mix all material even next to container or form edges and corners.

It is noted that the embodiment of the magnetic cigar or cigarette holder described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A hand held cementitious material mixing tool, comprising:

a) a tubular handle with an upper end and a lower end, a hand grip attached to an upper end of the tubular handle, b) a mixing head attached to a lower end of the tubular handle, wherein the mixing head includes a plurality of horizontally positioned mixing blades which are angled to lift and mix the cementitious material when the tool is pulled toward a user, c) a water delivery system including a water valve integral with the hand grip, a water nozzle located near a lower end of the tubular handle and directed to deliver water onto the cementitious material before the cementitious material contacts the mixing blades, tubing extending from the water valve to the water nozzle through the tubular handle, and d) an intermediate handle adjustable located between the hand grip and the water nozzle.

2. The hand held cementitious material mixing tool of claim 1 wherein the tubular handle further comprises a curved tubular handle which includes an upward curve in the handle near a lower end of the tubular handle and wherein the water nozzle is attached between the curved area and lower end of the tubular handle.

3. The hand held cementitious material mixing tool of claim 1 wherein the mixing head further comprises a mixing head with a vertical plane aligned perpendicular to a longitudinal axis of the tubular handle wherein the mixing head includes a plurality of horizontally positioned mixing blades wherein each blades includes a leading edge and trailing edge and wherein the leading edges are angled downward so that when the mixing blades are pulled through the cementitious material each mixing blade lifts and mixes cementitious material.

4. The hand held cementitious material mixing tool of claim 1 wherein the water deliver system further comprises a plurality of water nozzles mounted on the tubular handle near a lower end and directed to deliver water onto the cementitious material immediately before the cementitious material contacts the mixing blades when the tool is pulled through the cementitious material.

5. The hand held cementitious material mixing tool of claim 1 wherein the intermediate handle further comprise a half looped handle slidingly and rotationally mounted to the tubular handle between the hand grip and water nozzle.

6. The hand held cementitious material mixing tool of claim 1 wherein the mixing head further comprises two upright outside opposing vertical frame members, a top horizontal frame member extending between a top end of each upright vertical frame member, wherein the two upright vertical frame members and the top horizontal frame member resemble an inverted "U", multiple horizontal mixing blades mounted between the two upright vertical frame members and stacked one on top of the other with space between each for allowing the flow of cementitious material, each blade includes a leading edge orientated downwardly and a trailing edge orientated upwardly, so that when the mixing blades are pulled through cementitious material the material is lifted and mixed.

* * * * *